US010582826B2

(12) United States Patent
Hwang et al.

(10) Patent No.: US 10,582,826 B2
(45) Date of Patent: Mar. 10, 2020

(54) WATER CLEANING DEVICE AND CLEANER HAVING THE SAME

(71) Applicant: LG ELECTRONICS INC., Seoul (KR)

(72) Inventors: Philjae Hwang, Seoul (KR); Mantae Hwang, Seoul (KR); Jungbae Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 429 days.

(21) Appl. No.: 15/405,589

(22) Filed: Jan. 13, 2017

(65) Prior Publication Data

US 2017/0202421 A1 Jul. 20, 2017

(30) Foreign Application Priority Data

Jan. 14, 2016 (KR) ..... 10-2016-0004777

(51) Int. Cl.
*A47L 11/40* (2006.01)
*A47L 13/26* (2006.01)
*A47L 13/22* (2006.01)

(52) U.S. Cl.
CPC ..... *A47L 11/4094* (2013.01); *A47L 11/4044* (2013.01); *A47L 11/4083* (2013.01); *A47L 13/22* (2013.01); *A47L 13/26* (2013.01)

(58) Field of Classification Search
CPC ..... A47L 13/26; A47L 13/256; A47L 13/22; A47L 11/4094; A47L 11/4083; A47L 11/408; A47L 11/4044
USPC ..... 401/217, 245, 276
See application file for complete search history.

(56) References Cited

U.S. PATENT DOCUMENTS 610,750 A * 9/1898 Wickers ..... B01F 13/002 401/4
1,168,965 A * 1/1916 Rosenblum ..... A46B 11/0013 401/276
1,384,722 A * 7/1921 King ..... A47L 13/22 15/104.001
1,485,891 A * 3/1924 Sibley ..... A47L 13/22 15/229.6
3,806,261 A * 4/1974 Soultanian ..... A46B 11/066 401/136

(Continued)

FOREIGN PATENT DOCUMENTS

CN 2081236 7/1991
CN 2177442 9/1994

(Continued)

OTHER PUBLICATIONS

Extended European Search Report in European Application No. 17151151.2, dated Jun. 22, 2017, 7 pages (with English translation).

*Primary Examiner* — Patrick M. Buechner
(74) *Attorney, Agent, or Firm* — Fish & Richardson P.C.

(57) ABSTRACT

A cleaner includes a nozzle assembly, a cleaner body coupled to the nozzle assembly, and a water cleaning device coupled to the nozzle assembly. The water cleaning device includes a water tank that is configured to hold a cloth and that defines a water storage area and an air hole, and a control device that is configured to open or close the air hole and that includes a movable member located outside of the water storage area and configured to move between a first position and a second position to open or close the air hole.

20 Claims, 23 Drawing Sheets

(56) References Cited

U.S. PATENT DOCUMENTS

| | | | | |
|---|---|---|---|---|
| 4,488,330 | A * | 12/1984 | Grave | A47L 11/34 15/322 |
| 6,584,990 | B2 * | 7/2003 | Shaw | A47L 13/22 134/105 |
| 6,733,199 | B2 * | 5/2004 | Dingert | A47L 1/08 401/1 |
| 6,874,656 | B2 | 4/2005 | Rohr et al. | |
| 2005/0152737 | A1 * | 7/2005 | Tien | A47L 13/22 401/270 |
| 2006/0245820 | A1 | 11/2006 | Kresse et al. | |
| 2009/0252546 | A1 | 10/2009 | Kaleta et al. | |
| 2016/0088987 | A1 * | 3/2016 | Hwang | A47L 9/0054 15/415.1 |
| 2017/0202416 | A1 * | 7/2017 | Hwang | A47L 9/0686 |
| 2017/0231454 | A1 * | 8/2017 | Kingma | A47L 13/22 401/139 |

FOREIGN PATENT DOCUMENTS

| | | |
|---|---|---|
| CN | 1572665 | 2/2005 |
| CN | 204671068 | 9/2015 |
| KR | 10-2001-0028651 | 4/2001 |
| KR | 20-0422221 | 7/2006 |
| KR | 10-1014468 | 2/2011 |
| KR | 10-2013-0129060 | 11/2013 |
| WO | 2004062457 | 7/2007 |

* cited by examiner

WATER CLEANING DEVICE AND CLEANER HAVING THE SAME

CROSS-REFERENCE TO RELATED APPLICATION

This application claims priority under 35 U.S.C. 119 and 35 U.S.C. 365 to Korean Patent Application No. 10-2016-0004777 filed on Jan. 14, 2016 in Korea, the entire contents of which is hereby incorporated by reference in its entirety.

TECHNICAL FIELD

The present application generally relates to technologies about a cleaner.

BACKGROUND

The cleaner may be classified into a manual cleaner that a user manually grips and moves the cleaner and an automatic cleaner that automatically moves by itself.

For example, a manual cleaner may include a canister type cleaner, an upright type cleaner, a handy type cleaner, or a stick type cleaner.

SUMMARY

The present disclosure is related to a cleaner to remove dusts and waste.

In general, one innovative aspect of the subject matter described in this specification can be embodied in a cleaner including a nozzle assembly; a cleaner body that is coupled to the nozzle assembly; and a water cleaning device that is coupled to the nozzle assembly, the water cleaning device including: a water tank that is configured to hold a cloth and that includes: a water storage area that is configured to store water to provide to the cloth, and an air hole through which air comes in from an outside of the water tank, and a control device that is configured to open or close the air hole and that includes: a movable member that is located outside of the water storage area of the water tank and that is configured to move between a first position and a second position to open or close the air hole.

The foregoing and other embodiments can each optionally include one or more of the following features, alone or in combination. In particular, one embodiment includes all the following features in combination. The movable member is configured to contact the cloth at the first position, the cloth being held by the water tank. The water tank includes: a tank body that includes the air hole, and a base that is coupled to a first side of the tank body, wherein each of the tank body and the base includes a respective opening through which the movable member is configured to pass, and wherein the movable member includes a shielding part that is configured to block the air hole. The water cleaning device further includes: a cap that is coupled to the water tank and that is configured to cover the movable member; and an elastic member (i) that is respectively coupled to the cap and the movable member and (ii) that is configured to maintain the movable member in a position that closes the air hole using an elastic force. The water tank includes: a projection that is configured to block the movable member from rotating, and wherein the shielding part includes: a projection groove that is configured to couple to the projection. The water tank includes: a tank body, and a base that is coupled to a first side of the tank body, wherein the base includes: an air introduction guide that extends from the base and that includes the air hole, and wherein the movable member is configured to be accommodated in the air introduction guide. The water cleaning device further includes: a cap that is coupled to the base, that is configured to support the movable member, and that includes an opening through which the movable member passes, and an elastic member (i) that is respectively coupled to the air introduction guide and the movable member and (ii) that is configured to provide an elastic force to the movable member. The movable member is configured to: move between the first position and the second position by an external force, and based on a position of the movable member, open the air hole to introduce air into the water tank through the air hole. The movable member is configured to: move between the first position and the second position by an external force, and based on a position of the movable member, open the air hole to draw air through an airflow path that is formed between the cap and the movable member. The water tank includes a tank body including an accommodating groove that is configured to accommodate the movable member, wherein the accommodating groove includes the air hole, and wherein the movable member is configured to roll on the accommodating groove. The accommodating groove includes: a guide groove that is configured to guide the movable member to move toward the air hole. The guide groove slopes toward the air hole. The accommodating groove has a funnel shape and slopes toward the air hole. The water tank includes: a tank body that includes the air hole and in which the movable member is located, and a base that is coupled to a first side of the tank body, wherein the control device further includes: a stationary member that is fixed to the base and that is configured to couple to the movable member based on a position of the movable member, wherein the movable member is configured to open or close the air hole based on coupling between the stationary member and the movable member. The water cleaning device further includes: an elastic member that is configured to maintain the movable member decoupled from the stationary member using an elastic force. The tank body includes: an accommodating part that is configured to accommodate the movable member, wherein the accommodating part is coupled to the base. The movable member includes a hook, and wherein the accommodating part includes a projection part that is configured to couple to the hook to hold the movable member.

In general, another innovative aspect of the subject matter described in this specification can be embodied in a water cleaning device including a water tank that is configured to (i) hold a cloth and (ii) provide water to the cloth, the water tank including: an air hole through which air enters the water tank from outside of the water tank, and a water storage area that is configured to store water; and a control device (i) that is movable in the water tank, (ii) that is configured to control a flow of the air that enters through the air hole, and (iii) that is configured to move outside of the water storage area to open or close the air hole.

The foregoing and other embodiments can each optionally include one or more of the following features, alone or in combination. In particular, one embodiment includes all the following features in combination. The control device is configured to move between a first position and a second position in the water tank. The control device protrudes to a first side of the water tank and is configured to couple to the cloth that is held by the water tank.

The subject matter described in this specification can be implemented in particular embodiments so as to realize one or more of the following advantages. Comparing to a conventional cleaner, a cleaner can discharge water from a water tank using a control device. The control device can automatically discharge water during a cleaning process without user's manual manipulation.

Furthermore, the control device can control that water is discharged only during the cleaning process. Thus, the control device can reduce unnecessary water usage.

Also, a user can refill the water tank less frequently. Moreover, the control device can discharge water based on user's time settings, thus enhancing user experience.

In addition, the control device can continuously discharge water during the cleaning process, thus water can be continuously provided to a cleaning cloth of the cleaner.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
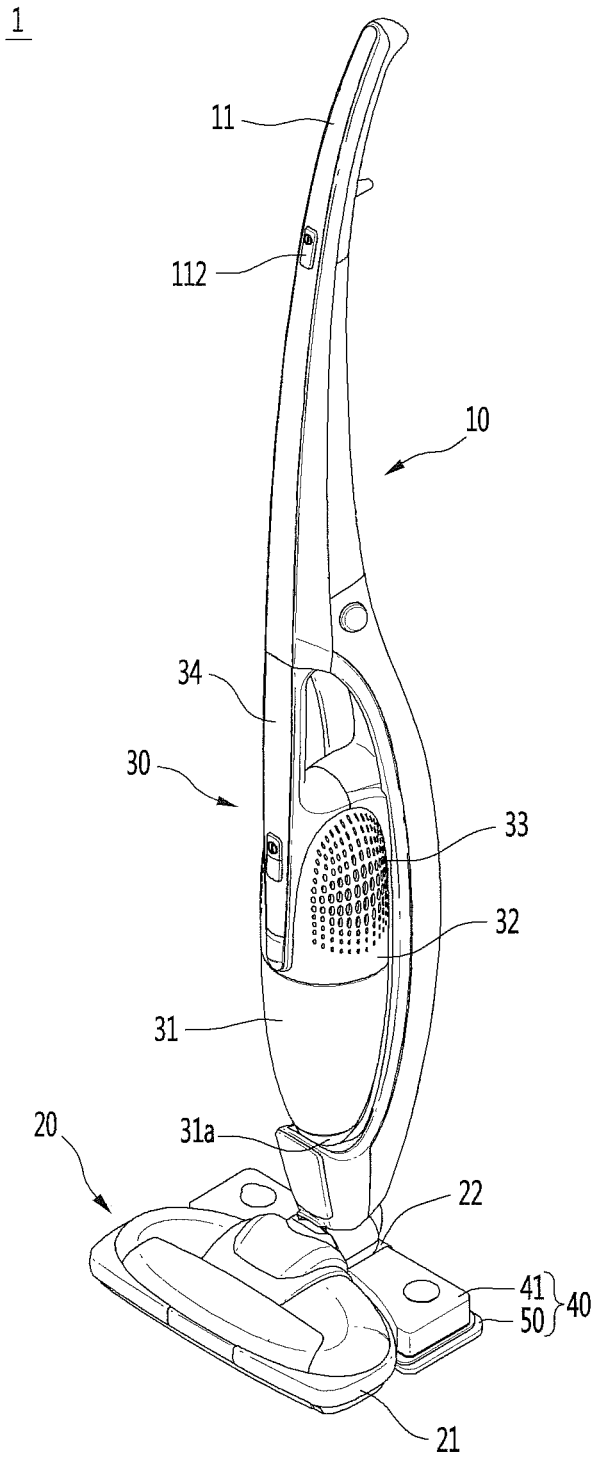
FIG. 1 is a diagram illustrating an example cleaner.
Figure 2:
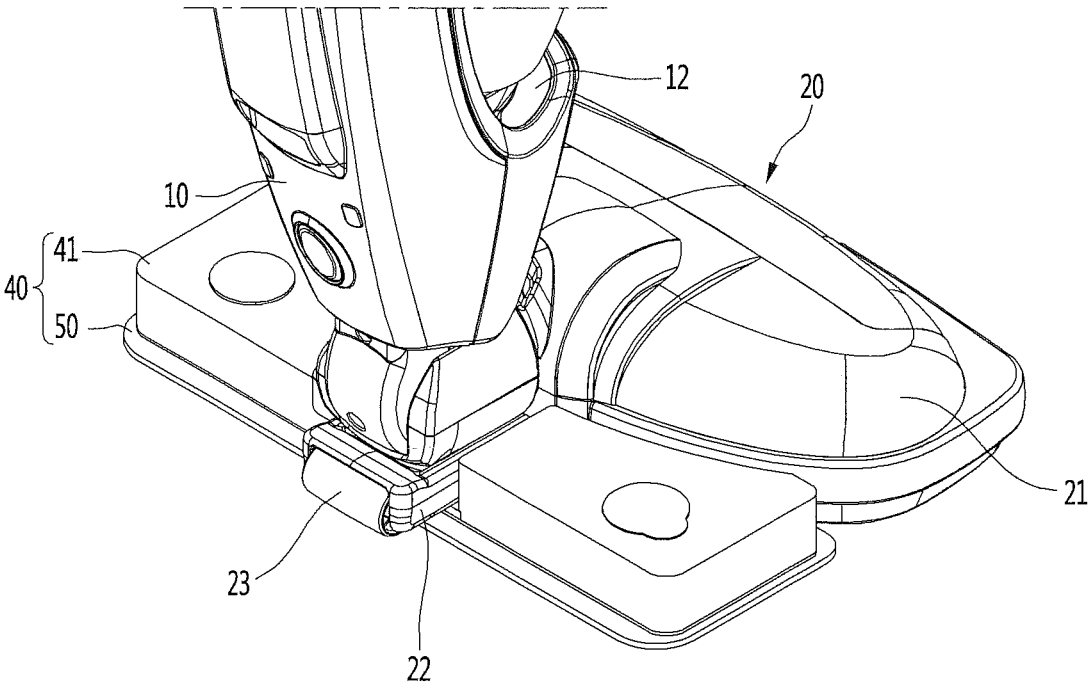
FIG. 2 is a diagram illustrating an example water cleaning device and an example nozzle assembly of the cleaner.

FIG. 1 illustrates an example cleaner. FIG. 2 illustrates an example water cleaning device and an example nozzle assembly of the cleaner Referring to FIG. 1 and FIG. 2, the cleaner 1 may include a nozzle assembly 20 to suction a dust from a floor, and a cleaner body 10 movably coupled to the nozzle assembly 20.

The nozzle assembly 20 may allow the dust suctioned therein to flow into the cleaner body 10.

The cleaner 1 may further include a cleaning unit 30 removably coupled to the cleaner body 10.

The cleaning unit 30 may include a body 32 having a suction motor (not shown), and a dust collection unit 31 removably coupled to the body 32 to collect the dust separated from the air.

The dust collection unit 31 may include an air inlet 31*a* to receive an air from the cleaner body 10. The cleaner body 10 may have an air-communication unit 12 communicating with the air inlet 31*a*. The air-communication unit 12 may be disposed at a portion on which the air inlet 31*a* is mounded.

The dust collection unit 31 may include a cover (not shown) to open or close the air inlet 31*a*. The cover may open the air inlet 31*a* under a suction force of the suction motor. To the contrary, when the suction motor is not activated, the cover may close the air inlet 31*a*.

Thus, when the suction motor is not activated, the cover closes the air inlet 31*a*, to prevent the dust in the dust collection unit 31 from being discharged out of the air inlet 31*a*.

The body 32 may have an air outlet 33 to allow the air passing through the suction motor to be discharged out of the body 32. Further, the body 32 may have a handle 34 at an upper position thereof.

The cleaning unit 30 may further include a battery (not shown) to supply a power to the suction motor.

Thus, when the cleaning unit 30 is removed from the cleaner body 10, the user may perform cleaning using the cleaning unit 30.

Further, when the cleaning unit 30 is mounted on the cleaner body 10, the suction motor may be activated.

The cleaner body 10 may have a body handle 11. Around the body handle 11, a control unit 112 may be disposed. The user may control the suction motor in the cleaning unit 30 using the control unit 112.

The nozzle assembly 20 may include a nozzle body 21, and a connection 22 extending from the nozzle body 21 and rotatably coupled to the cleaner body 10.

The connection 22 may, for example, extend rearwards in a rear of the nozzle body 21.

A water cleaning device 40 may be coupled to the nozzle assembly 20.

The water cleaning device 40 may include a water tank 41, and a cloth 50 attached to the water tank 40. The water tank 40 may supply water to the cloth 50 to allow the cloth 50 wet with water to remove the floor dust.

The cloth 50 may be attached to the water tank 40 at a bottom of thereof via adhering portion (490 in FIG. 5) such as Velcro. The adhering portion to attach the cloth 50 to the water tank 40 may not be limited thereto.

In this example, as long as the water tank 40 is attached to the nozzle assembly 20, a structure of the nozzle assembly 20 and/or a presence/absence the cleaning unit 30 are not limited specifically.

In some implementations, the water tank 40 is not coupled to the cleaner but has a stick coupled to the water cleaning device 40 to clean the floor using the cloth of the water cleaning device 40.

The water cleaning device 40 may be disposed under the nozzle assembly 20. The water cleaning device 40 may be at least partially disposed outside the nozzle assembly 20 when coupled to the nozzle assembly 20.

That is, as shown in FIG. 2, the water cleaning device may be partially disposed under the nozzle body 21 to be overlapped with the nozzle body 21. The water cleaning device 40 may be partially disposed under the connection 22 to be overlapped with the connection 22. Further, the water tank 40 may be partially disposed not to be overlapped with both the nozzle body 21 and the connection 22.

Thus, when the water cleaning device 40 is coupled to the nozzle assembly 20, the water cleaning device 40 is partially disposed outside the nozzle assembly 20 to allow a contact area between the cloth 50 and water tank 41 to increase. This may lead to increase the contact area between the cloth 50 and floor.

In this example, at a single time cleaning operation, the cloth 50 may remove the dust in a larger area on the floor.

Further, when the user puts one foot on a portion of the water cleaning device 40 outside the nozzle assembly 20, the user may lift up the cleaner 1 to allow the water cleaning device 40 to be removed from the nozzle assembly 20. Thus, the user may remove the water cleaning device 40 from the cleaner 1 easily. In order to remove the water cleaning device 40, the water cleaning device 40 needs not a separate structure.

Further, when the water cleaning device 40 contacts with the nozzle assembly 20, the contact area between the cleaner and floor area increases, to allow the cleaner to stand up on the floor area more stably in the cleaner standby mode.

The water cleaning device 40 may be coupled to the nozzle body 21 and/or the connection 22.

The connection 22 may have one or more rear wheels 23 to allow the nozzle assembly 20 to move easily.

Figure 3:
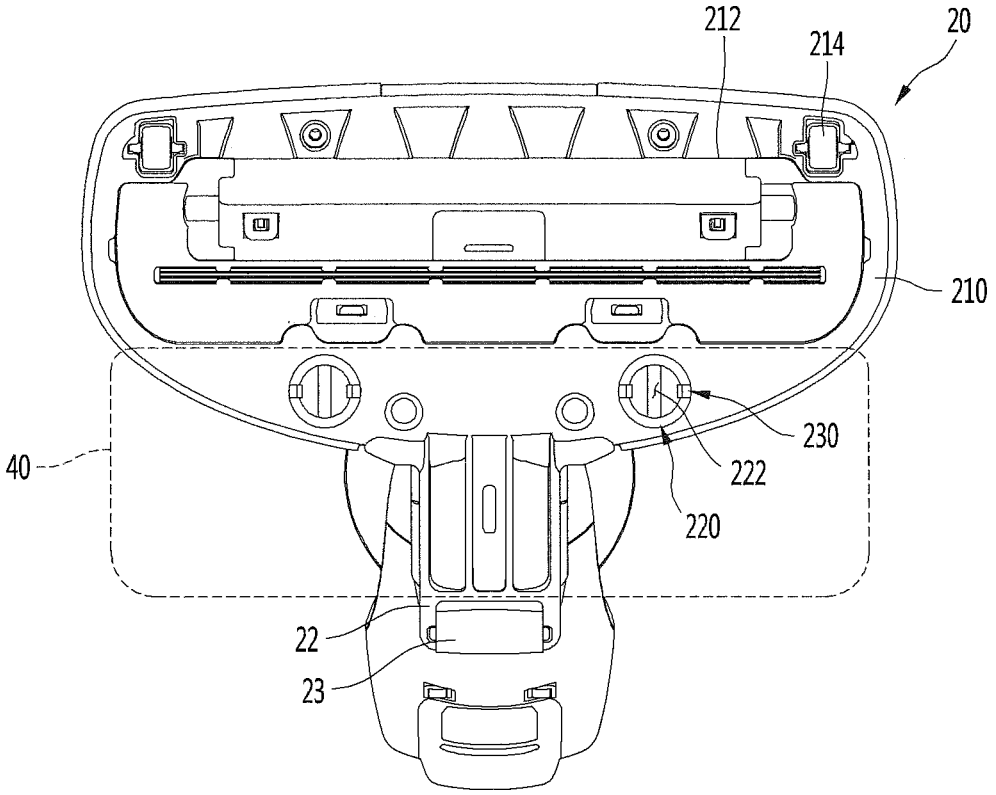
FIG. 3 is a diagram illustrating an example nozzle assembly.
Figure 4:
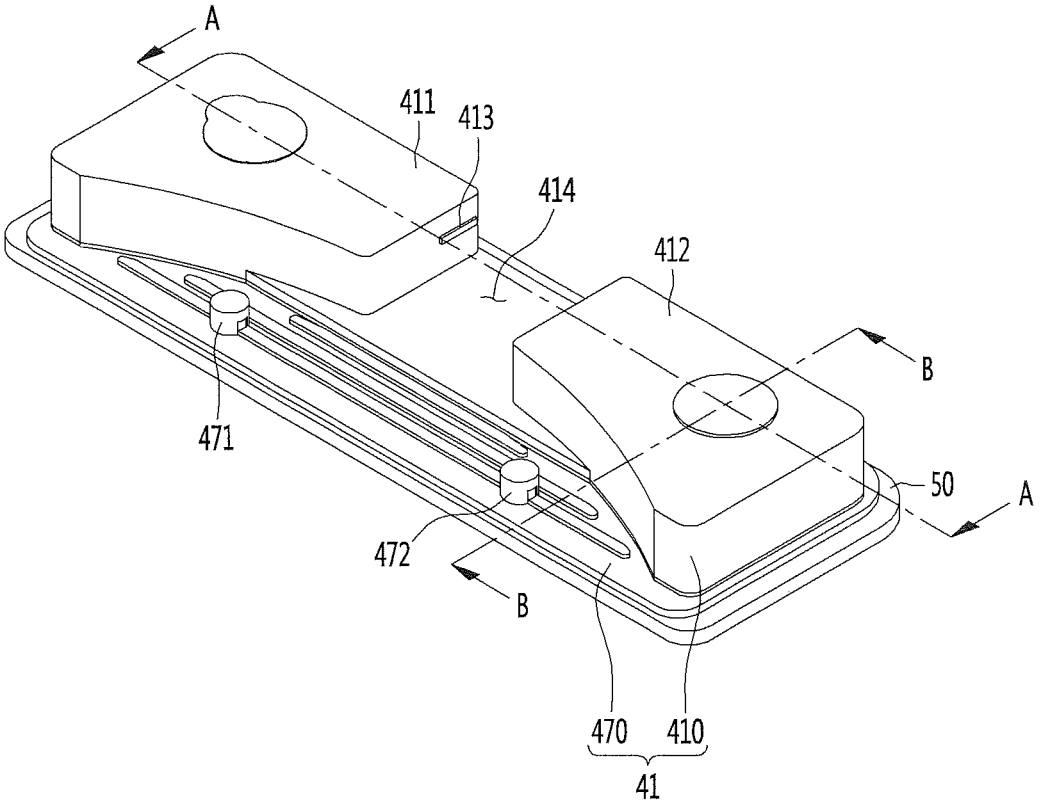
FIG. 4 is a diagram illustrating an example water cleaning device.

FIG. 3 illustrates an example nozzle assembly. FIG. 4 illustrates an example water cleaning device.

Referring to FIG. 3 and FIG. 4, the nozzle body 21 may have an air inlet 212.

Further, the nozzle body 21 may have one or more front wheels 214 to move the nozzle assembly 20.

That is, the nozzle assembly 20 may have a plurality of wheels 23 and 214. The plurality of wheels 23 and 214 may include one or more front wheels 214 disposed at the nozzle body 21, and one or more rear wheels 23 disposed at the connection 22.

In order for the nozzle assembly 20 to move stably, a plurality of front wheels 214 may be disposed at the nozzle body 21. The plurality of front wheels 214 may be spaced from each other in a left-right direction.

In order to prevent the water cleaning device 40 from blocking the air inlet 212, the water cleaning device 40 may be disposed in a rear of the air inlet 212. Further, in order to prevent interference between the water cleaning device 40 and the plurality of wheels 23 and 214, the water cleaning device 40 may be disposed in a rear of the front wheel 214 and in a front of the rear wheel 23.

That is, when the water cleaning device 40 is coupled to the nozzle assembly 20, the water cleaning device 40 may be disposed between the front wheel 214 and the rear wheel 23. Further, the water cleaning device 40 may be disposed between the air inlet 212 and the rear wheel 23.

The water tank 41 may include a tank body 410 and a base 470 coupled to a lower side of the tank body 410.

The water tank 41 forms one or more water storage parts 411 and 412. In FIG. 4, a case where the water tank 41 includes a first water storage part 411 and a second water storage part 412 is disclosed as an example, but the number of water storage parts 411 and 412 is not limited in this example. The one or more water storage parts 411 and 412 form a water storage space.

A space 414 in which the connection 22 of the nozzle assembly 20 is located is formed in the tank body 410. Although not limited, the space 414 may be located between the water storage parts 411 and 412.

Thus, if the water cleaning device 40 is coupled to the nozzle assembly 20, the tank body 410 can support the connection 22.

The water tank 41 may further include a coupling device for allowing the water tank 41 to be coupled to the nozzle assembly 20.

The coupling device may include a first coupling part 471 or 472 for allowing the coupling device to be coupled to the nozzle body 21.

The first coupling part 471 or 472, although not limited, may protrude upward from the base 470. In order for the water tank 41 to be firmly coupled to the nozzle body 21, a plurality of first coupling parts 471 and 472 may be provided at the base 470. The plurality of first coupling parts 471 and 472 may be disposed to be spaced apart from each other in the left-right direction.

The nozzle body 21 may include an accommodating part 220 in which the first coupling part 471 or 472 is accommodated. The accommodating part 220 may be formed as the bottom of the nozzle body 21 is recessed upward.

When the plurality of first coupling part 471 or 472 are provided in the water tank 41, a plurality of accommodating parts 220 may be provided in the nozzle body 21. In this example, the plurality of accommodating parts 220 may also be spaced apart from each other in the left-right direction.

The nozzle body 21 may include a hook member 230 coupled to the first coupling part 471 or 472 in a state in which the first coupling part 471 or 472 is accommodated in the accommodating part 220.

The hook member 230 may be fixed to the nozzle body 21, and at least a portion of the hook member 230 may protrude to the accommodating part 220.

In the process in which the first coupling part 471 or 472 is accommodated in the accommodating part 220, if the hook member 230 is elastically deformed by the first coupling part 471 or 472 and then aligned with a hook accommodating part (not shown) of the first coupling part 471 or 472, the hook member 230 may be accommodated in the hook accommodating part of the first coupling part 471 or 472.

The coupling device may further include a second coupling part 413 for allowing the coupling device to be coupled to the connection 22.

The second coupling part 413 may be formed at the tank body 410. At this time, since the connection 22 is located between the two water storage parts 411 and 412, the second coupling part 413 may be formed at each of the water storage parts 411 and 412. As an example, the second coupling part 413 may be formed at surfaces of the water storage parts 411 and 412, which are opposite to each other.

If the connection 22 is located between the two water storage parts 411 and 412, the second coupling part 413 may be held to a top surface of the connection 22.

In this example, as the water storage parts 411 and 412 are located at both sides of the connection 22, respectively, the nozzle assembly 20 can be prevented from being separated from the water tank 41 in a process of moving the nozzle assembly 20 to the left or right.

Figure 5:
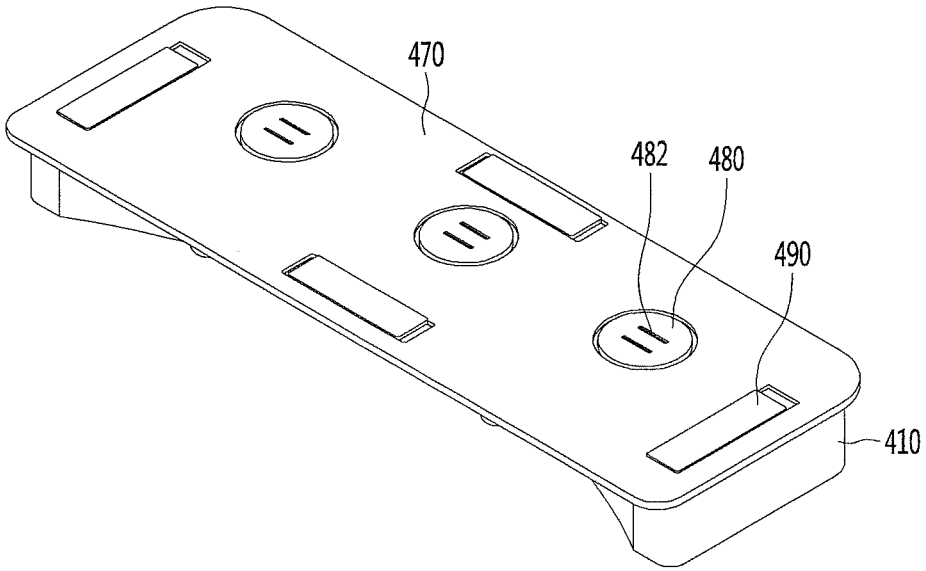
FIG. 5 is a diagram illustrating an example water tank.
Figure 6:
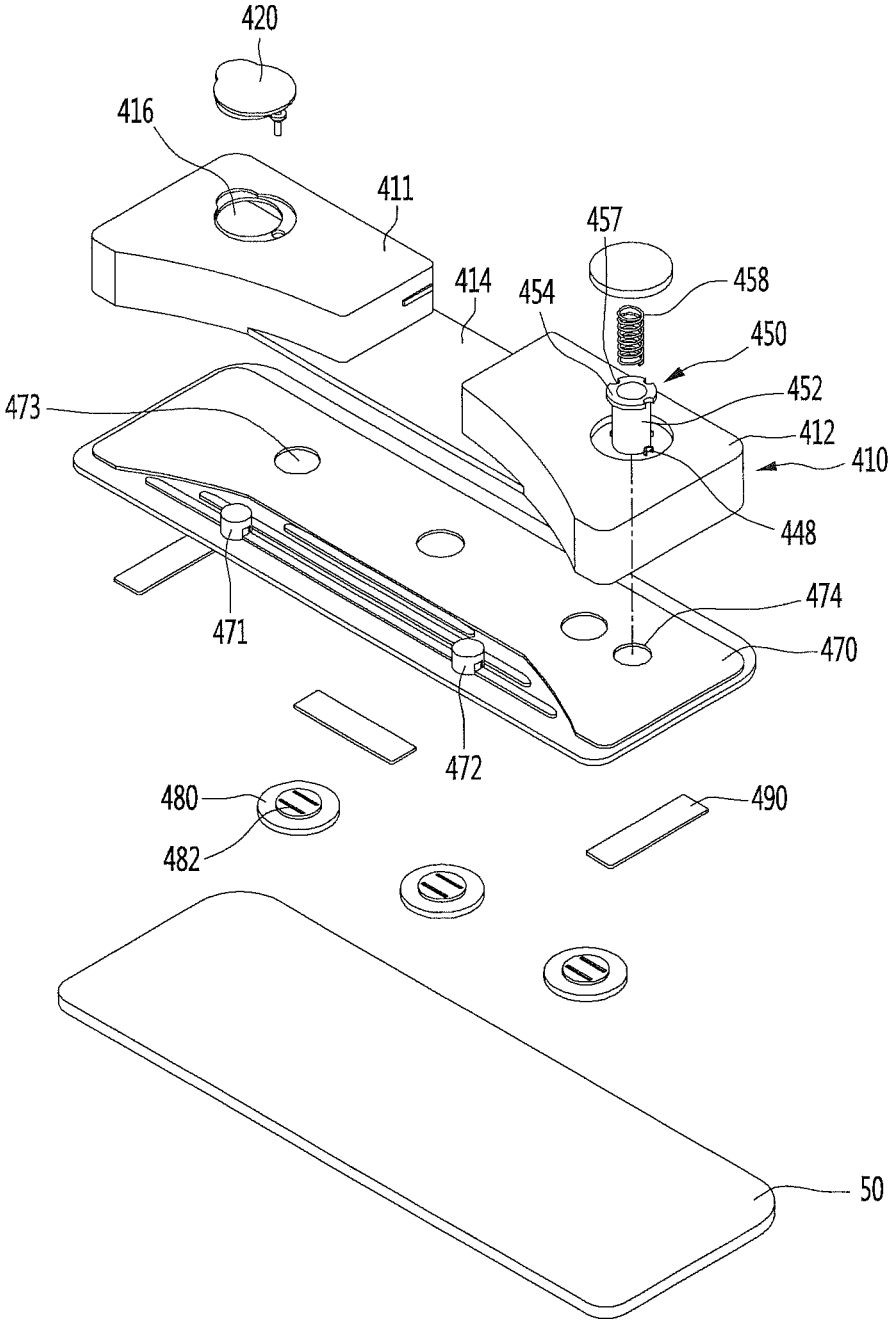
FIG. 6 is a diagram illustrating an example water cleaning device.
Figure 7:
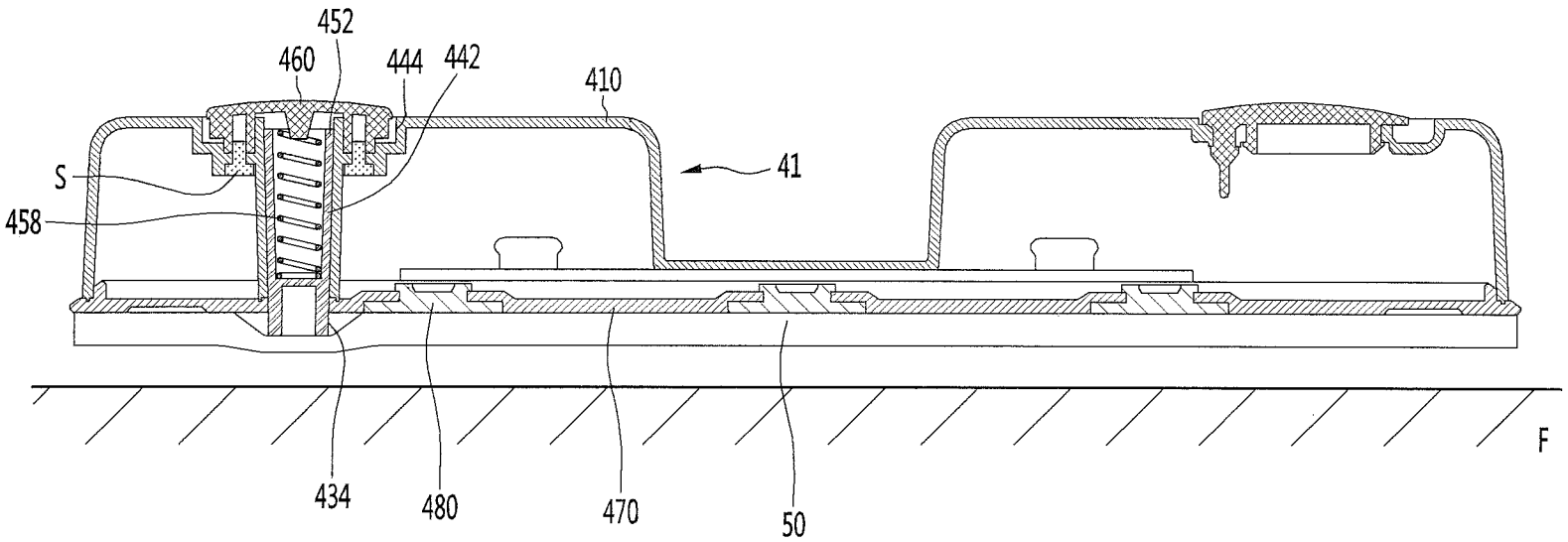
FIGS. 7 and 8 are diagrams illustrating an example water cleaning device in FIG. 4.
Figure 8:
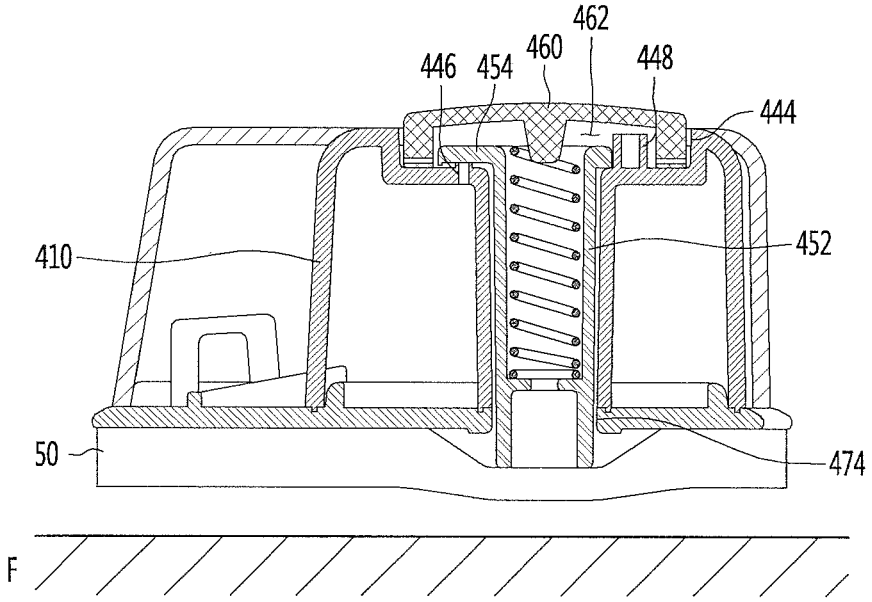

FIG. 5 illustrates an example water tank. FIG. 6 illustrates an example water cleaning device. FIGS. 7 and 8 illustrate an example water cleaning device in FIG. 4.

In FIGS. 7 and 8, the water cleaning device is spaced apart from a floor F.

Referring to FIGS. 4 to 8, the tank body 410 may include a water inlet 416 that enables water to be introduced thereinto.

The water inlet 416 may be opened and closed by a water inlet cover 420. Although not limited, the water inlet 416 may be provided in the first water storage part 411.

An opening 473 may be provided in the base 470. A discharge part 480 for allowing water to be discharged therefrom may be coupled to the opening 473. The discharge part 480 may include one or more discharge holes 482. As another example, the discharge part 480 may be removed, and the opening 473 may serve as the discharge part.

The water stored in the water tank 41 may be supplied to the cloth 50 through the discharge hole 482.

One or more adhering portion 490 for allowing the cloth 50 to be adhered to the base 470 may be coupled to a bottom surface of the base 470.

In some implementations, the water tank 41 may further include a control device for controlling introduction of air into the water tank 41.

By the control device 450, the internal and external spaces of the water tank 41 may be communicated with each other, or the communication between the internal and external spaces of the water tank 41 may be interrupted.

At this time, if the communication between the internal and external spaces of the water tank 41 is interrupted by the control device 450, the internal space of the water tank becomes a state identical or similar to that of vacuum pressure, so that water can be prevented from being discharged through the discharge hole 482.

In some implementations, if the internal and external spaces of the water tank 41 are communicated with each other by the control device 450, the pressure of the internal space of the water tank 41 is identical or similar to air pressure, and thus the water can be smoothly discharged through the discharge hole 482.

Specifically, the control device 450 may include a movable member 452 movably disposed in the water tank 41.

The movable member 452 may pass through the water tank 41. In this example, the movable member 452 may pass through the water tank 41 in the top-bottom direction.

Although the movable member 452 passes through the water tank 41, the movable member 452 is located at the outside of the water storage space formed by the water storage parts 411 and 412. That is, the movable member 452 is movable at the outside of the water storage space.

A first through-hole 442 for allowing the movable member 452 to pass therethrough may be formed in the tank body 410, and a second through-hole 474 for allowing the movable member 452 to pass therethrough may be formed in the base 470.

In addition, an air hole 446 for allowing air to be introduced into the water tank 41 therethrough is provided in the tank body 410. In some implementations, the air hole 446 and the movable member 450 may be provided in the second water storage part 412. In some other implementations, the air hole 446 and the movable member 450 may be provided in the first water storage part 411.

The movable member 452 opens or closes the air hole 466 in a process of moving in the top-bottom direction. That is, the movable member 452 may adjust the amount of air passing through the air hole 446. As an example, the air does not pass through the air hole 446 in a state in which the air hole 446 is closed, and may pass through the air hole 446 in a state in which the air hole 446 is opened.

The movable member 452 may include a shielding part 454 for shielding the air hole 446. The shielding part 454 may extend in the horizontal direction from a cylinder-shaped body.

A mounting groove 444 for allowing the shielding part 454 to be mounted therein may be formed in the tank body 410. The mounting groove 444 may be formed as a top surface of the tank body 410 is recessed downward.

As an example, the air hole 446 may be formed in the bottom of the mounting groove 444. Thus, if the shielding part 454 of the movable member 452 is mounted in the mounting groove 444, the shielding part 454 closes the air hole 446.

The control device 450 may further include a cap 460 coupled to the tank body 410, the cap 460 covering an upper side of the movable body 452.

The cap 460, although not limited, may be fastened to the tank body 410 by a fastening member S such as a screw.

The control device may further include an elastic member 458 that provides an elastic force to the shielding member 454 such that the state in which the shielding part 454 closes the air hole 446 is maintained.

As an example, a lower end of the elastic member 458 may be supported by the movable member 452, and the other end of the elastic member 458 may be in contact with a bottom surface of the cap 460. In addition, a portion of the elastic member 458 may be accommodated in the movable member 452.

In order for the movable member 452 to be pressurized and lifted by the floor F as the cloth 50 is in contact with the floor F in a cleaning process, the movable member 452 may protrude downward of the base 470 in a state in which the shielding part 454 of the movable member 452 closes the air hole 446.

In this example, even in a state in which the cloth 50 is adhered to the base 470, the state in which the shielding part 454 of the movable member 452 closes the air hole 446 is maintained by the elastic force of the elastic member 458.

That is, the elastic force of the elastic member 458 is greater than the pressurization force with which the cloth 50 upwardly pressurizes the movable member 452 in the state in which the cloth 50 is adhered to the water tank 41.

A space 462 for preventing interference between the cap 460 and the movable member 452 in the process of lifting the movable member 452 is provided in the cap 460.

In addition, one or more projections 448 may be formed at the tank body 410 to prevent the movable member 452 from rotating about a vertical line, and a projection groove 457 in which the one or more projections 448 are accommodated may be formed in the shielding part 454.

Hereinafter, an operation of the control device 450 will be described.

Figure 9:
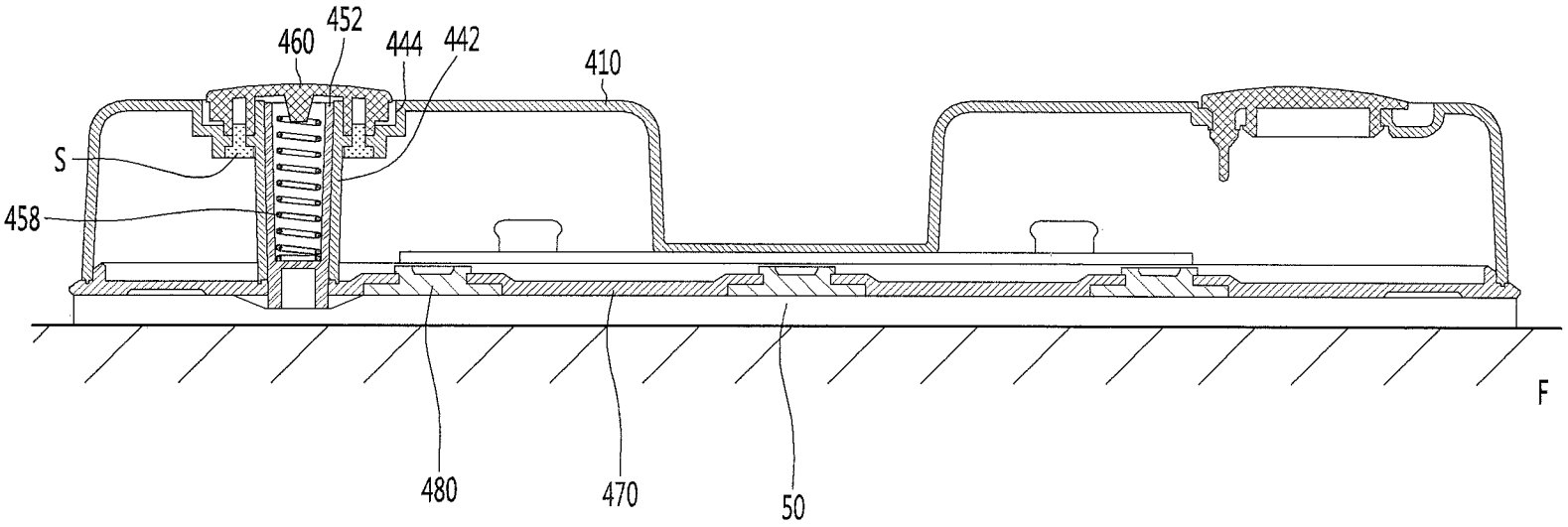
FIG. 9 is a diagram illustrating an example water cleaning device in FIG. 7.
Figure 10:
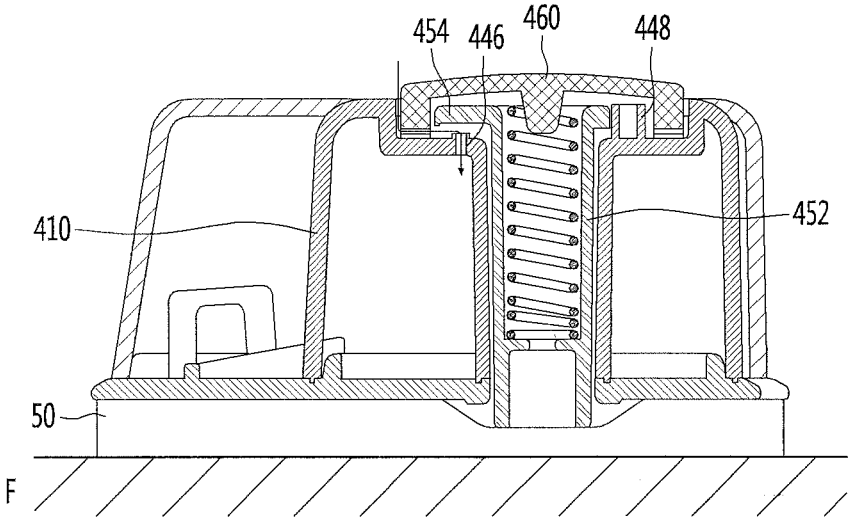
FIG. 10 is a diagram illustrating an example water cleaning device in FIG. 8.

FIG. 9 illustrates an example water cleaning device in FIG. 7. FIG. 10 illustrates an example water cleaning device in FIG. 8.

First, referring to FIGS. 7 and 8, in a state in which the cloth 50 of the water cleaning device 40 is spaced apart from the floor F, the elastic force of the elastic member 458 acts on the movable member 452 such that the shielding part 454 of the movable member 452 closes the air hole 446.

In the state in which the air hole 446 is closed, external air is prevented from being introduced into the water tank 41 through the air hole 446.

In this example, the internal space of the water tank 41 becomes a state identical or similar to that of the vacuum pressure, so that water can be prevented from being discharged through the discharge hole 482.

In this example, the state in which the cloth 50 is spaced apart from the floor F may be a case where the water cleaning device or the cleaner is moved.

If the water is prevented from being discharged through the discharge hole 482 in a process in which the user moves while gripping the water cleaning device or the cleaning, the water can be prevented from being unnecessarily discharged through the discharge hole 482 except the cleaning process.

If the water is prevented from being unnecessarily discharged from the water tank 41, the time required to use water stored in the water tank 41 is increased, so that the number of times of filling water in the water tank 41 can be decreased.

In some implementations, FIGS. 9 and 10, if the cloth 50 of the water cleaning device 40 is placed on the floor F, the movable member 452 is upwardly pressurized by the floor F.

Then, the movable member 452 is lifted, and the shielding member 454 of the movable member 452 is spaced apart from the air hole 446, so that the air hole 446 is opened. If the air hole 446 is opened, air is introduced into the water tank 41 through the air hole 446. Hence, the internal pressure of the water tank 41 is identical or similar to the air pressure, and thus water is discharged through the discharge hole 482.

The water discharged through the discharge hole 482 is supplied to the cloth 50 such that the cloth 50 absorbs the water.

Thus, the user can clean the floor F using the cloth 50 that absorbs the water.

In some implementations, the air hole 446 is closed in processes except the cleaning process, so that water can be prevented from being unintentionally discharged from the water tank 41.

Further, in this example, the air hole 446 is opened in the cleaning process without user's manual manipulation of the control device 450, so that user's convenience can be improved.

In some implementations, it has been described that the air hole 446 is opened as the movable member 452 is lifted when the cloth 50 is in contact with the floor F. In some implementations, the air hole 446 may be opened as the movable member 452 is lifted when the state in which the movable member 452 closes the air hole 446 as long as the user does not apply an external force to the water cleaning device 40, and the user pressurizes the water cleaning device 40 toward the floor F with the pressurization force having a predetermined magnitude or more.

Such a structure can be implemented by adjusting one or more of the protruding length of the movable member 452 protruding downward by passing through the base 470, the elastic coefficient of the elastic member 458, and the thickness of the cloth 50.

When a reaction applied to the movable member 452 from the floor F is smaller than the elastic force of the elastic member 458 in the state in which the water cleaning device 40 is placed on the floor F, and a lower end of the movable member 452 protruding by passing through the base 470 is in contact with the cloth 50 without providing the pressurization force from the user, the state in which the air hole 446 is closed is maintained.

In this state, if the user downwardly pressurizes the water cleaning device 40 while performing cleaning, the reaction applied to the movable member 452 from the floor F is increased. Hence, the reaction applied to the movable member 452 becomes larger than the elastic force of the elastic member 458. Accordingly, the movable member 452 is lifted, and thus the air hole 446 is opened.

in some implementations, the state in which the air hole 446 is closed is maintained, so that water can be prevented from being discharged from the water tank 41.

Figure 11:
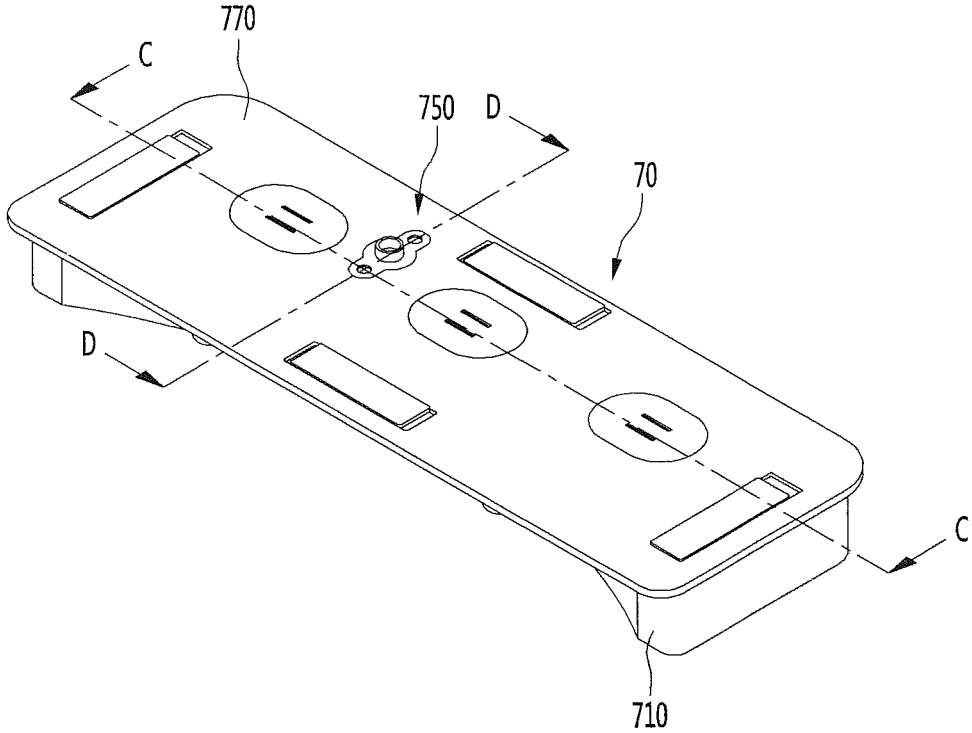
FIGS. 11 and 12 are diagrams illustrating an example water tank.
Figure 12:
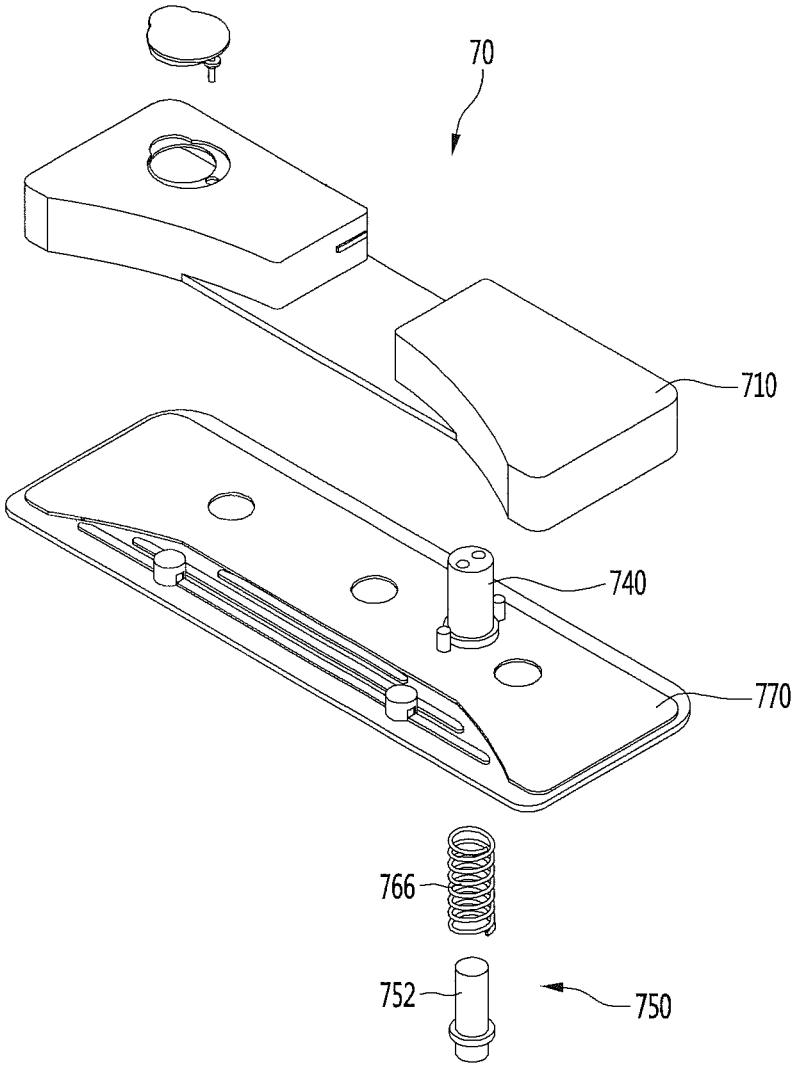
Figure 13:
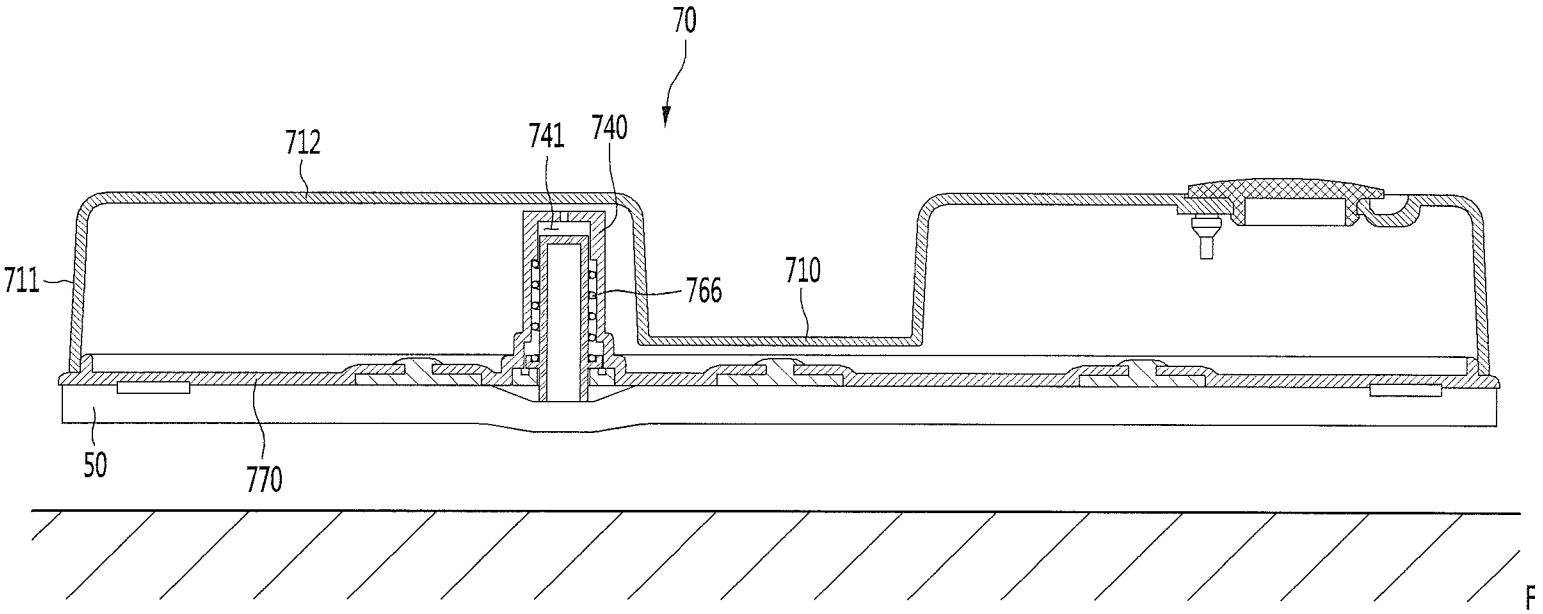
FIGS. 13 and 14 are diagrams illustrating an example water tank in FIG. 11.
Figure 14:
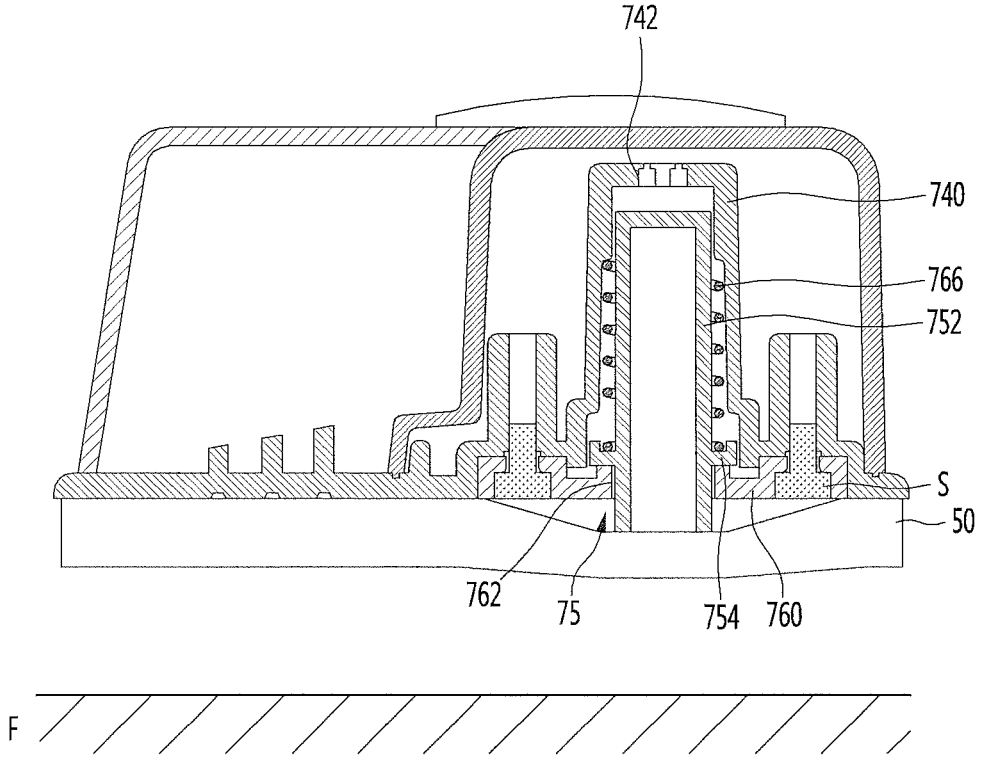

FIGS. 11 and 12 illustrate an example water tank. FIGS. 13 and 14 illustrate an example water tank in FIG. 11.

Referring to FIGS. 11 to 13, the water tank 70 may include a tank body 710 and a base 770 coupled to a lower side of the tank body 710.

An air introduction guide 740 may be provided to the base 770, and an air hole 742 may be formed in the air introduction guide 740.

The air introduction guide 740 may extend upward from the base 770, and an air flow path 741 may be formed inside the air introduction guide 740.

In addition, the water tank 70 may further include a control device 750 for allowing the internal and external spaces of the water tank 70 to communicate with each other or interrupting the communication between the internal and external spaces of the water tank 70.

The control device 750 may include a movable member 752 located in the air flow path 741. That is, the movable member 752 may be accommodated in the air introduction guide 740.

As an example, the movable member 752 may be inserted into the air introduction guide 740 at a lower side of the base 770.

The external diameter of the movable member 752 is smaller than the internal diameter of the air introduction guide 740. Thus, a path for allowing air to flow therealong is formed between the movable member 752 and the air introduction guide 740.

In this example, a top surface of the air introduction guide 740 may be located adjacent to a top surface 712 of a water storage part 711 in the tank body 710 so as to prevent water in the water tank 70 from being discharged through the air hole 742, and the air hole 724 may be located in the top surface of the air introduction guide 740.

In addition, the top surface of the air introduction guide 740 may be spaced apart from the top surface 712 of the water storage part 711 such that air can be introduced into the water tank 70 through the air hole 742.

The air introduction guide 740 is located at the outside of a water storage space formed by the water storage part 711. The movable member 752 is movably disposed at the outside of the water storage space.

The control device 750 may further include a cap 760 fastened to the base 770, the cap 760 preventing the air introduction guide 740 from being separated from the base 770.

The cap 760 may be fastened to a lower side of the base 770 by a fastening member S such as a screw.

An opening 762 for allowing the movable member 752 to pass therethrough may be formed in the cap 760. In this example, the diameter of the opening 762 may be larger than the diameter of the movable member 752. Thus, a path for allowing air to flow therealong is formed between the inner circumferential surface of the opening 762 and the movable member 752.

At this time, the movable member 752 may be provided with an extending part 754 extending in the horizontal direction, and the extending part 754 may be mounted on a top surface of the cap 760. If the extending part 754 is mounted on the top surface of the cap 760, air is prevented from being introduced into the air flow path 741 through the opening 762.

The control device 750 may further include an elastic member 766 that provides an elastic force to the extending part 754 such that the state in which the extending part 754 is mounted on the cap 760 is maintained.

A top end of the elastic member 756 may be in contact with a projection formed at the inner circumferential surface of the air introduction guide 740, and a bottom end of the elastic member 756 may be in contact with the extending part 754.

Figure 15:
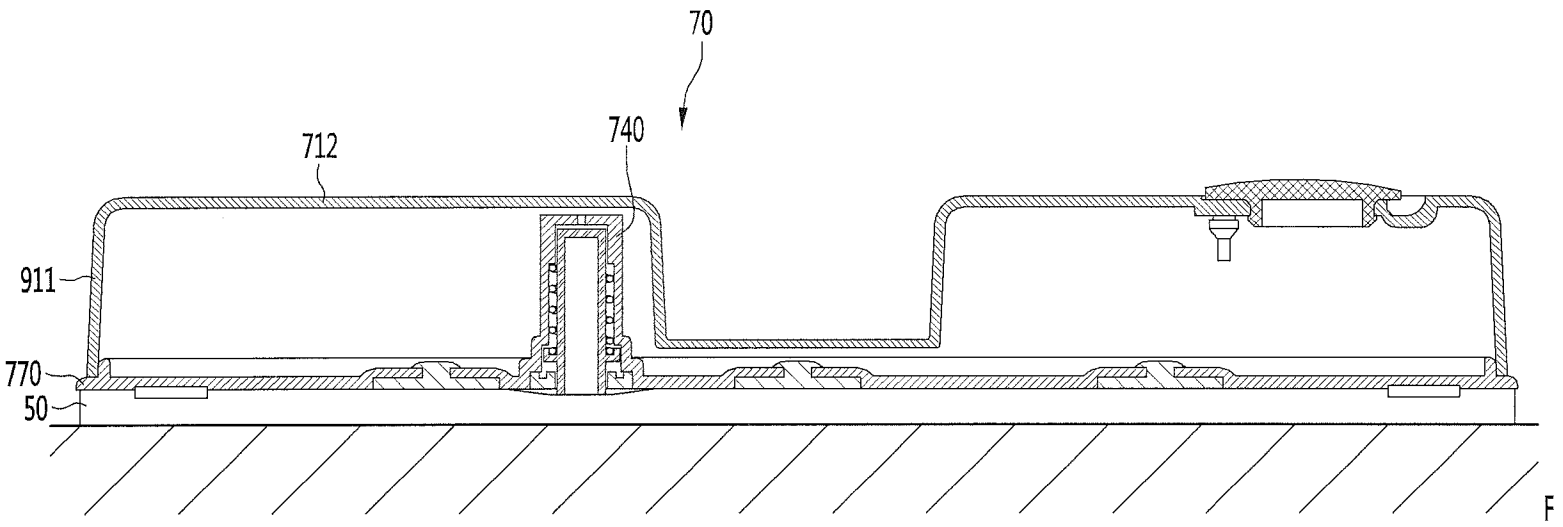
FIG. 15 is a diagram illustrating an example water cleaning device of FIG. 13.
Figure 16:
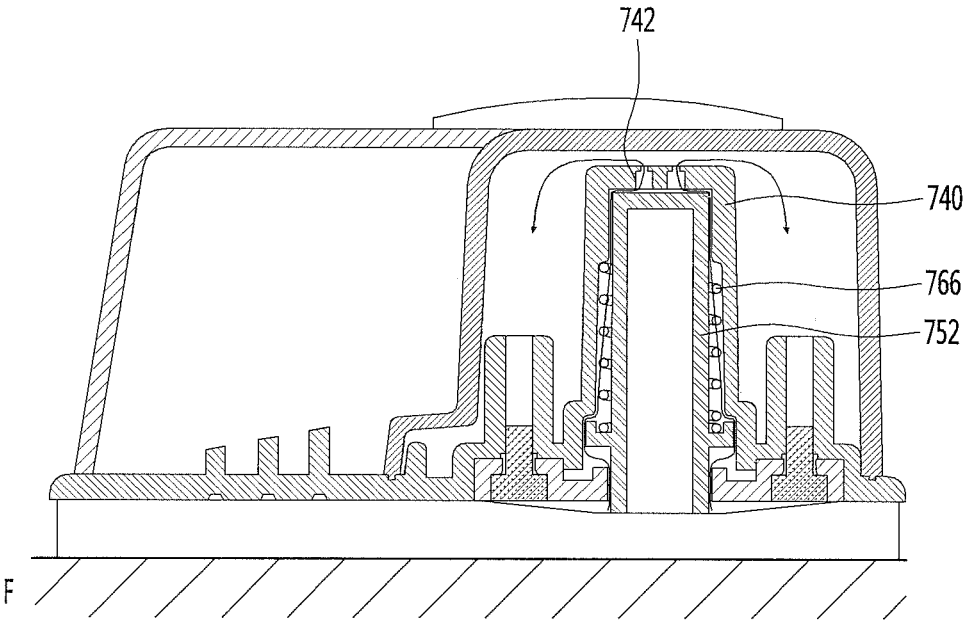
FIG. 16 is a diagram illustrating an example water cleaning device of FIG. 14.

FIG. 15 illustrates an example water cleaning device of FIG. 13. FIG. 16 illustrates an example water cleaning device of FIG. 14.

Referring to FIGS. 13 and 14, the elastic force of the elastic member 766 acts on the movable member 752 in the state in which the cloth 50 is spaced apart from the floor F, so that the state in which the extending part 754 of the movable member 752 is mounted on the cap 760 is maintained.

In this state, air is not introduced into the air flow path 741 through the opening 762 of the cap 760, and accordingly, the air is prevented from being introduced into the water tank 70.

In this example, the internal space of the water tank 70 becomes a state identical or similar to that of the vacuum pressure, so that water can be prevented from being discharged from the water tank 70.

Referring to FIGS. 15 and 16, if the cloth 50 is placed on the floor F, the movable member 752 is upwardly pressurized by the floor F.

Then, the movable member 752 is lifted, and the extending part 754 of the movable member 752 is spaced apart from the top surface of the cap 760.

Then, air is introduced into the air flow path 741 through the opening 762 of the cap 760, and the air introduced into the air flow path 741 is introduced into the water tank 70 through the air hole 742. Then, the internal pressure of the water tank 70 becomes identical to the air pressure, so that water can be discharged from the water tank 70.

In this example, the introduction of air into the air flow path 741 is prevented as long as the user does not downwardly pressurize the water cleaning device in the state in which the cloth 50 adhered to the water tank is in contact with the floor F, and, when the user downwardly pressurizes the water cleaning device, the movable member 752 is lifted such that the air is introduced into the air flow path 741.

The flow of air through the air hole 742 is controlled as the movable member 752 moves in the top-bottom direction, which is the same as that the air hole 742 is substantially opened or closed. Therefore, this may be understood as that the movable member 752 opens or closes the air hole 742.

In this example, if the movable member is lifted, air can be introduced into the air flow path. On the contrary, the length of the movable member 752 may be increased, and a path for allowing air to flow therealong may be formed in the extending part 754 of the movable member 752 or the cap 760.

Then, in a state in which an external force is not applied to the movable member 752, a top surface of the movable member 752 is spaced apart from the air hole 742, and external air is introduced into the air flow path 741 along the path. In this example, the air introduced into the air flow path 741 may pass through the air hole 742 and then introduced into the water tank 70.

On the other hand, if external force is applied to the movable member 752, e.g., if the water cleaning device is placed on the floor, the movable member 752 is lifted, and therefore, the top surface of the movable member 752 may close the air hole 742. In this example, water can be prevented from being discharged from the water tank 70.

Accordingly, the discharge of water from the water tank can be interrupted in the cleaning process, and the water can be discharged from the water tank in the state in which the water tank is spaced apart from the floor.

Figure 17:
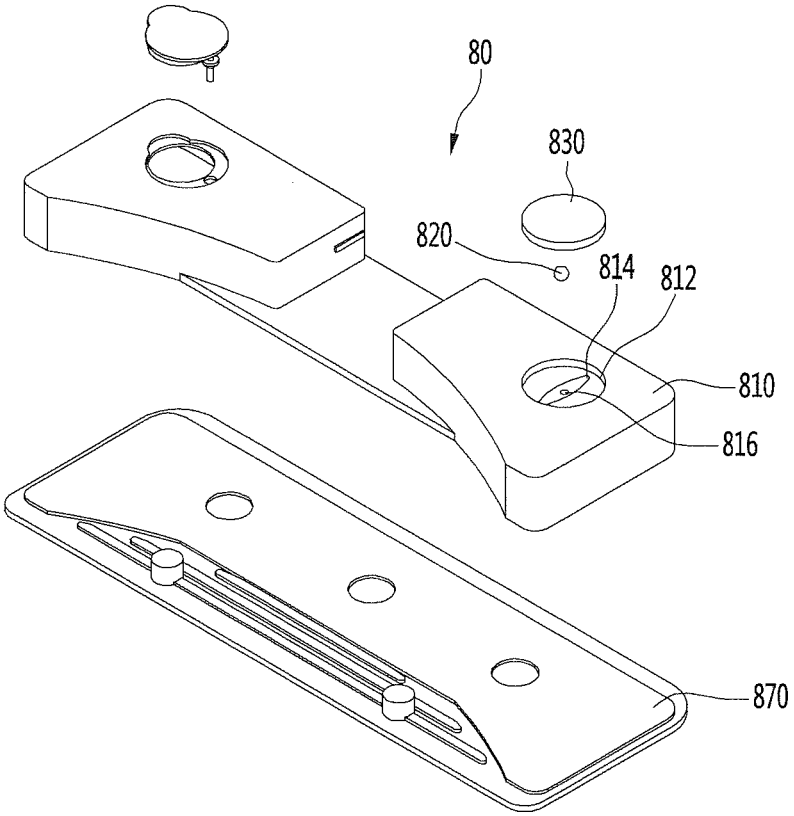
FIG. 17 is a diagram illustrating an example water tank.
Figure 18:
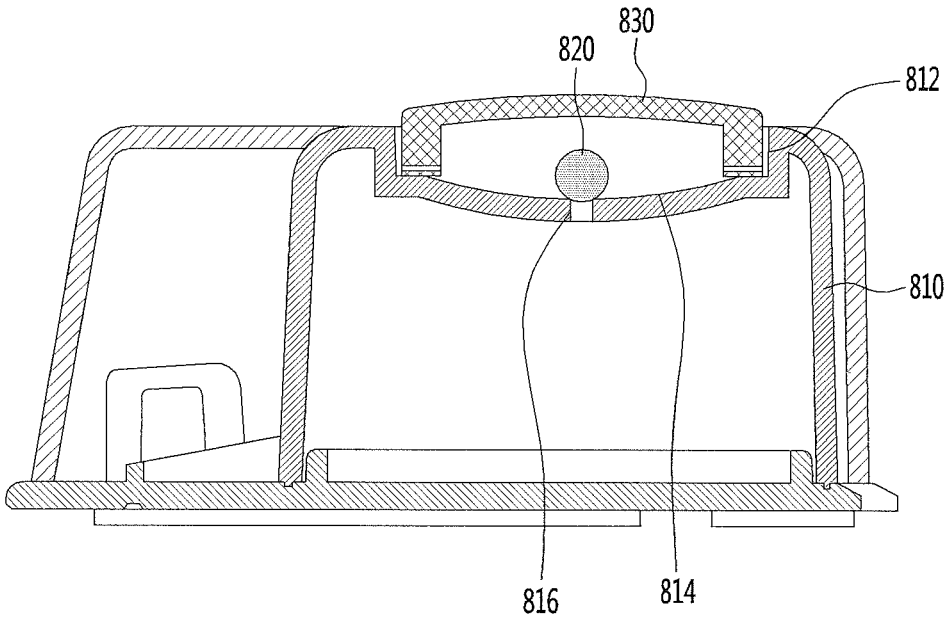
FIG. 18 is a diagram illustrating an example water tank including an air hole when the air hole is closed.
Figure 19:
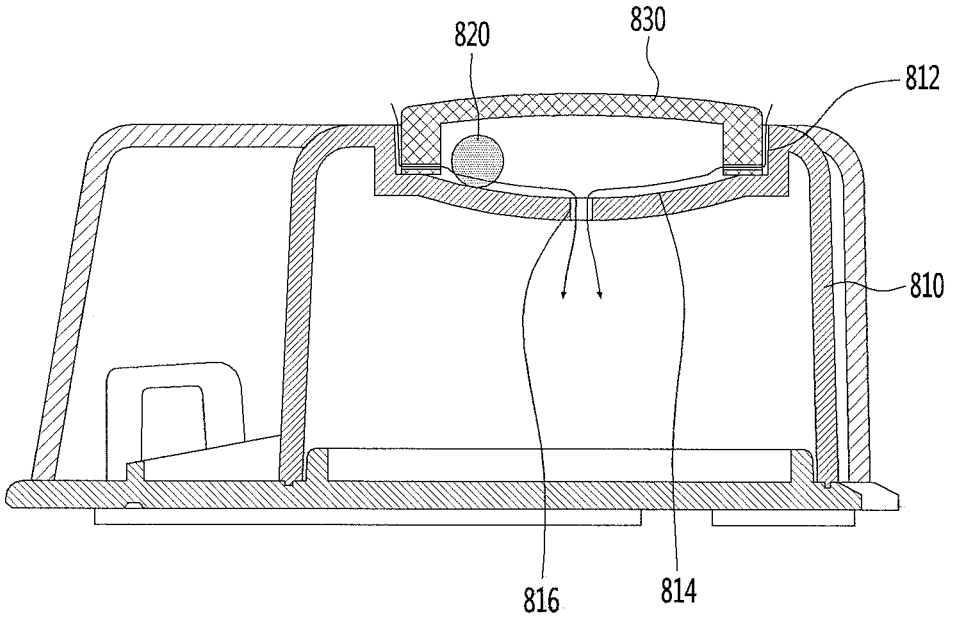
FIG. 19 is a diagram illustrating an example water tank including an air hole when the air hole is open.

FIG. 17 illustrates an example water tank. FIG. 18 illustrates an example water tank including an air hole when the air hole is closed. FIG. 19 illustrates an example water tank including an air hole when the air hole is open.

Referring to FIGS. 17 to 19, the water tank 80 may include a tank body 810 and a base 870 coupled to the tank body 810. In addition, an air hole 816 may be formed in the tank body 810.

The water tank 80 may further include a control device 820 for opening or closing the air hole 816.

The control device 820 includes a movable member. The movable member may be, for example, a ball formed in a spherical shape.

An accommodating groove 812 in which the control device 820 is accommodated may be formed in the tank body 810, and the air hole 816 may be provided in the accommodating groove 812. The accommodating groove 812 is an external space of a water storage space formed by the water tank 80, and the control device 820 is movably disposed at the outside of the water storage space.

In addition, a cap 830 that covers the accommodating groove 812 to prevent the control device 820 from being separated from the accommodating groove 812 may be coupled to the tank body 810.

In this example, a guide groove 814 that guides the control device 820 to move toward the air hole 816 may be provided in the accommodating groove 812 such that the state in which the control device 820 closes the air hole 816 can be maintained as long as an external force is not applied to the water tank 80.

The guide groove 814 may be provided in the bottom of the accommodating groove 812. The guide groove 814 may be formed to be upwardly inclined outward from the air hole 816. That is, the air hole 816 may be located at a portion of which height is lowest from a bottom surface of the guide groove 814.

In some implementations, the guide groove 814 may be removed, and the accommodating groove 812 may be formed to be inclined such that the height of a portion at which the air hole 816 is located is lowest. As an example, the bottom surface of the accommodating groove 812 may be formed such that its diameter is decreased as approaching its lower side, and the air hole 816 may be formed at a portion at which the height of the bottom surface of the accommodating groove 812 is lowest.

In this example, if an external force is not applied to the water tank 80 as shown in FIG. 18, the state in which the control device 820 closes the air hole 816 can be maintained.

Further, if the external force is applied to the water tank 80 as shown in FIG. 19, the control device 820 moves in the accommodating groove 812 such that the air hole 816 is opened, and external air can be introduced into the water tank 80 through the air hole 816.

Figure 20:
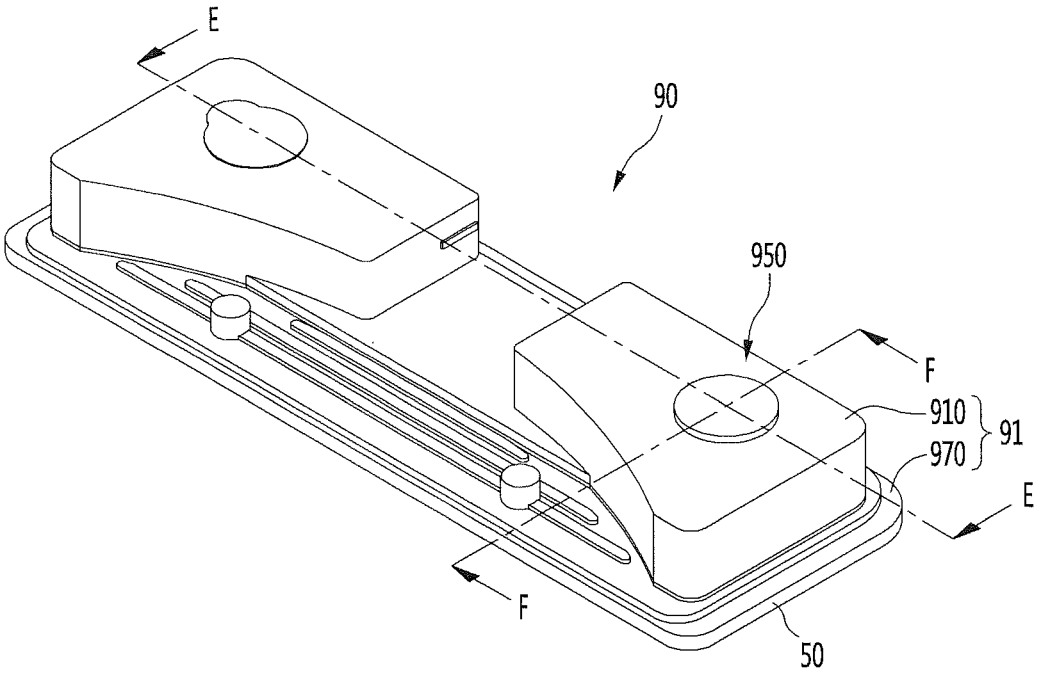
FIG. 20 is a diagram illustrating an example water cleaning device.
Figure 21:
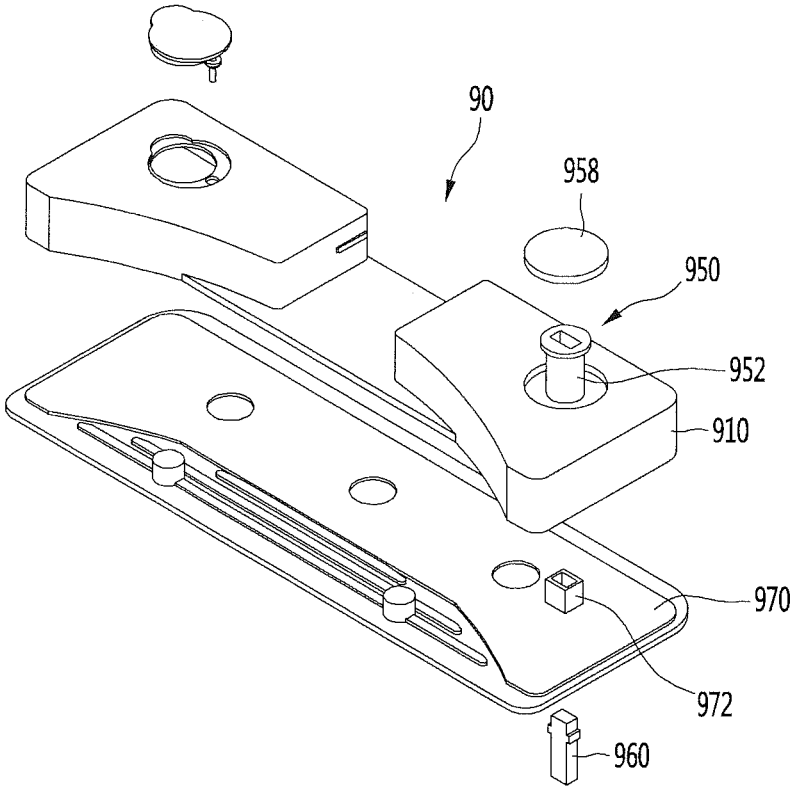
FIG. 21 is a diagram illustrating an example water tank.
Figure 22:
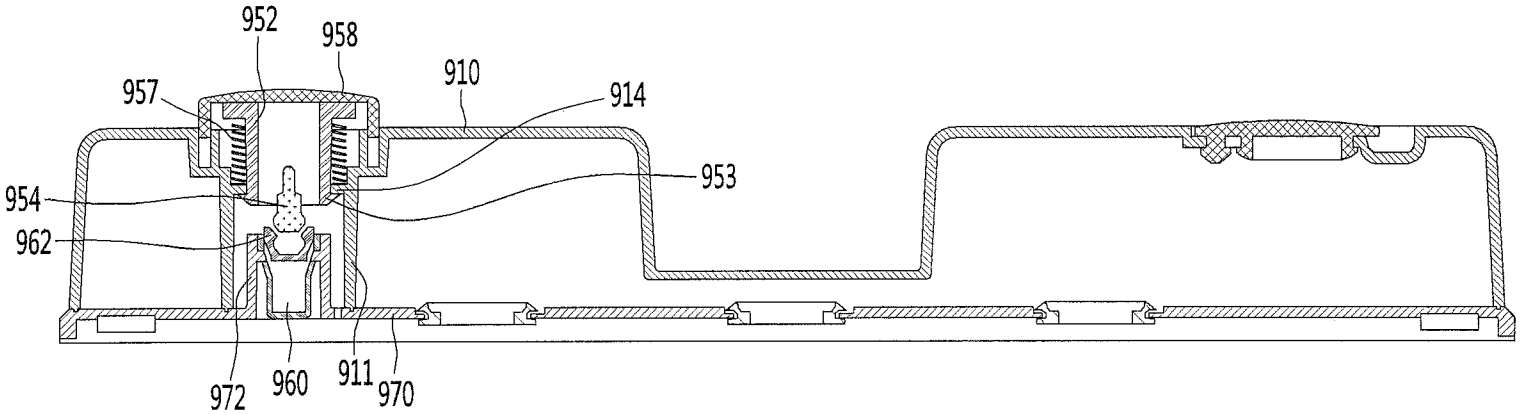
FIG. 22 is a sectional view of the example water cleaning device in FIG. 20 taken along the line E-E.
Figure 23:
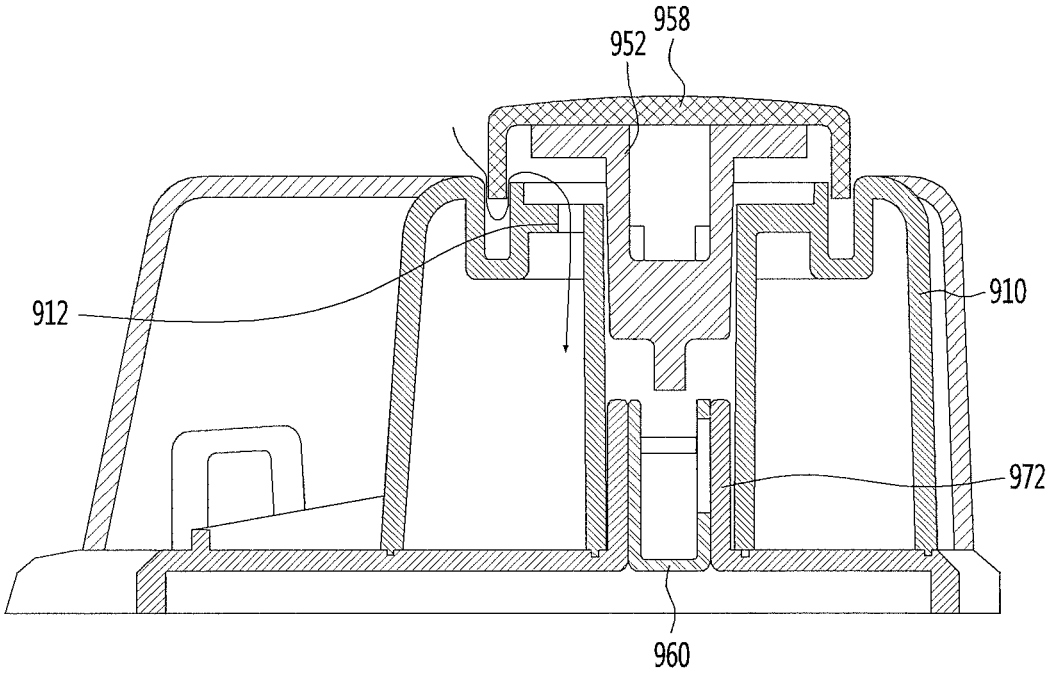
FIG. 23 is a sectional view of the example water cleaning device in FIG. 20 taken along the line F-F.

FIG. 20 illustrates an example water cleaning device. FIG. 21 illustrates an example water tank. FIG. 22 illustrates an example water cleaning device in FIG. 20. FIG. 23 illustrates an example water cleaning device in FIG. 20.

FIGS. 22 and 23 illustrate that an air hole is opened.

Referring to FIGS. 20 to 23, the water cleaning device 90 may include a water tank 90 and a cloth 50 coupled to a lower side of the water tank 91.

The water tank 91 may include a tank body 910 and a base 970 coupled to a lower side of the tank body 910. An air hole 912 may be formed in the tank body 910.

The water cleaning device 90 may further include a control device 950 for allowing the internal and external spaces of the water tank 90 to communicate with each other or interrupting the communication between the internal and external spaces of the water tank 90.

The control device 950 may include a movable member 952 movably disposed in the tank body 910, and a stationary member 960 provided to the base 970, the stationary member 960 being selectively coupled to the movable member 952.

The movable member 952 may open or close the air hole 912 in a process in which the movable member 952 moves in the tank body 910.

A first accommodating part 911 for accommodating the movable member 952 therein may be provided in the tank body 910, and a second accommodating part 972 for accommodating the stationary member 960 therein may be provided to the base 970.

The first accommodating part 911 may extend in the top-bottom direction in the tank body 910. If the base 970 is coupled to the tank body 910, the first accommodating part 911 may be seated on and in contact with a top surface of the base 970.

Accordingly, water in the water tank 91 can be prevented from being leaked to the first accommodating part 911 in a state in which the base 970 is coupled to the tank body 910. At this time, the first accommodating part 911 is located at the outside of a water storage space formed by the water tank 91. Thus, the movable member 952 is movably disposed at the outside of the water storage space.

In addition, if the base 970 is coupled to the tank body 910, the second accommodating part 972 may be accommodated in the first accommodating part 911.

The movable member 952 may include a hook 953, and a projection part 914 held by the hook 953 may be provided on the inner circumferential surface of the first accommodating part 911.

In this example, the hook 953 may be provided to be elastically deformable. If the hook 953 holds the projection part 914 as the movable member 952 is accommodated in the first accommodating part 911, the movable member 952 can be prevented from being upwardly separated from the first accommodating part 911.

A first coupling part 954 may be provided to the movable member 952, and a second coupling part 962 capable of being coupled to the first coupling part 954 may be provided to the stationary member 960.

The control device 950 may further include an elastic member 957 that elastically supports the movable member 952.

One end of the elastic member 957 may be mounted on the projection part 914, and the other end of the elastic member 957 may be in contact with the movable member 952.

The elastic member 957 provides the movable member 952 with an elastic force for allowing the state in which the coupling between the first and second coupling parts 954 and 962 is released to be maintained.

As an example, in the state in which the coupling between the first and second coupling parts 954 and 962 is released, the elastic member 957 provides the movable member 952 with an elastic force that allows the movable member 952 to move upward.

The control device 950 may further include a cap 958 that covers a top side of the movable member 952.

As the user presses the cap 958, the first coupling part 954 and the second coupling part 962 may be coupled to each other. As the user again presses the cap 958 in the state in which the first coupling part 954 and the second coupling part 962 are coupled to each other, the coupling between the first and second coupling parts 954 and 962 may be released. It will be apparent that the cap 958 may be omitted, and the user may directly press the movable member 952.

That is, in this example, the control device 950 may be manually operated by the user.

Figure 24:
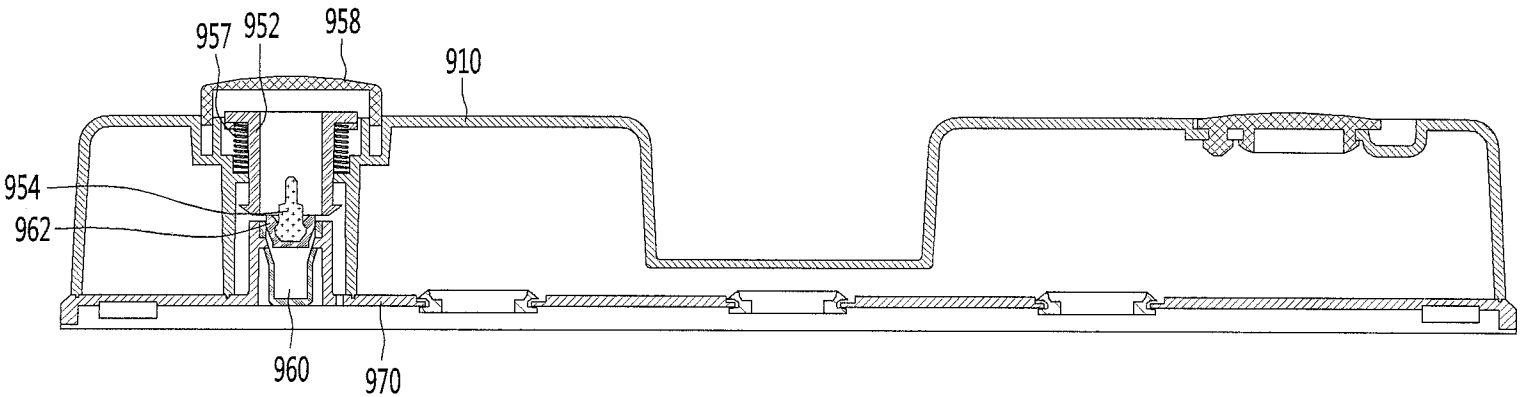
FIG. 24 is a diagram illustrating an example water tank of FIG. 22, where an air hole of the water tank is opened.
Figure 25:
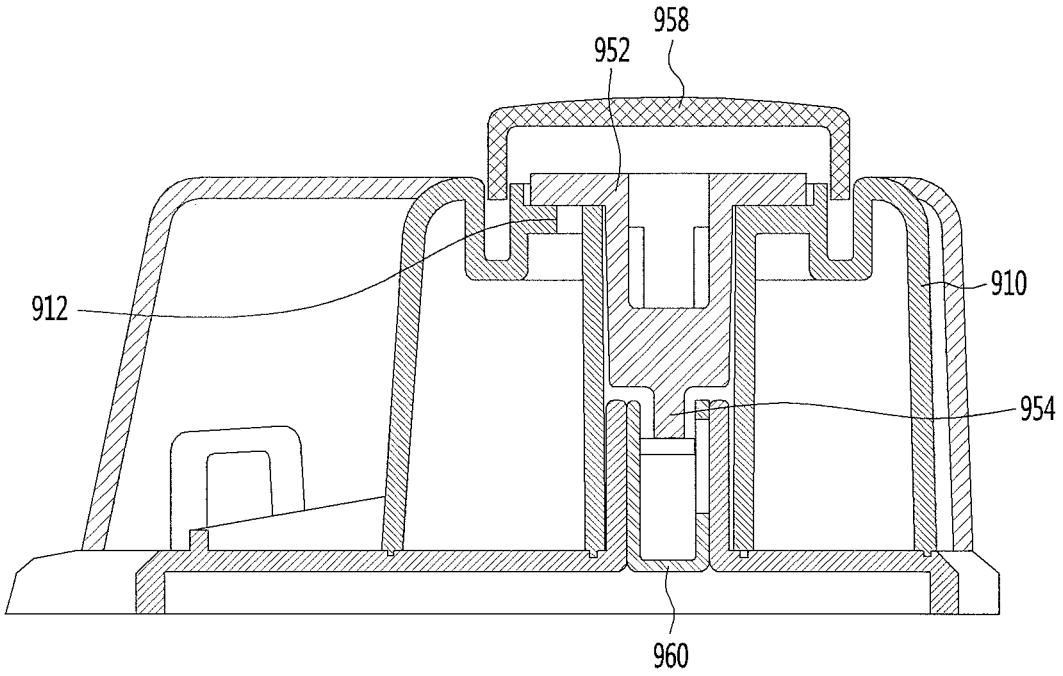
FIG. 25 is a diagram illustrating an example water tank of FIG. 23, where an air hole of the water tank is opened.

FIG. 24 illustrates an example water tank of FIG. 22, where an air hole of the water tank is opened. FIG. 25 illustrates an example water tank of FIG. 23, where an air hole of the water tank is opened.

In FIGS. 24 and 25, the state in which the movable member 952 is spaced apart from the air hole 912 is maintained in the state in which the coupling between the first coupling part 954 of the movable member 952 and the second coupling part 962 of the stationary member 960 is related.

Then, air is introduced into the water tank 91 through the air hole 912, and water can be discharged from the water tank 91.

In some implementations, referring to FIGS. 24 and 25, the user may press the cap 958 such that water is prevented from being discharged from the water tank 91. If the cap 958 is pressed, the movable member 952 coupled to the cap 958 moves downward such that the first coupling part 954 of the movable member 952 is coupled to the second coupling part 962 of the stationary member 960.

In the state in which the first coupling part 954 is coupled to the second coupling part 962, the movable member 952 closes the air hole 912 such that water is prevent from being discharged from the water tank 91.

In this state, the user may press the cap 958 so as to enable the water to be again discharged from the water tank 91. Then, as the coupling between the first coupling part 954 and the second coupling part 962 is released, the movable member 952 is lifted by the elastic force of the elastic member 957, and accordingly, the air hole 912 is opened. If the air hole 912 is opened, water is discharged from the water tank 91.

The invention claimed is:

1. A cleaner comprising:

a nozzle assembly;

a cleaner body that is coupled to the nozzle assembly; and a water cleaning device that is coupled to the nozzle assembly, the water cleaning device including:

a water tank that is configured to hold a cloth and that includes:

a water storage area that is configured to store water and to provide water to the cloth, and an air hole through which air comes in from an outside of the water tank, a control device that is configured to open or close the air hole and that includes a movable member that is located outside of the water storage area of the water tank and that is configured to move between a first position and a second position to open or close the air hole, and a cap configured to insert into the water tank and cover the control device.

2. The cleaner of claim 1, wherein the water tank includes a tank body including an accommodating groove that is configured to accommodate the movable member, wherein the accommodating groove includes the air hole, and wherein the movable member is configured to roll on the accommodating groove.

3. The cleaner of claim 2, wherein the accommodating groove has a funnel shape and slopes toward the air hole.

4. The cleaner of claim 2, wherein the accommodating groove includes:

a guide groove that is configured to guide the movable member to move toward the air hole.

5. The cleaner of claim 4, wherein the guide groove slopes toward the air hole.

6. A cleaner comprising:

a nozzle assembly;

a cleaner body that is coupled to the nozzle assembly; and a water cleaning device that is coupled to the nozzle assembly, the water cleaning device including:

a water tank that is configured to hold a cloth and that includes:

a water storage area that is configured to store water and to provide water to the cloth, and an air hole through which air comes in from an outside of the water tank, and a control device that is configured to open or close the air hole and that includes:

a movable member that is located outside of the water storage area of the water tank and that is configured to move between a first position and a second position to open or close the air hole, wherein the water tank further includes:

a tank body that includes the air hole and in which the movable member is located, and a base that is coupled to a first side of the tank body, wherein the control device further includes:

a stationary member that is fixed to the base and that is configured to couple to the movable member based on a position of the movable member, and wherein the movable member is configured to open or close the air hole based on coupling between the stationary member and the movable member.

7. The cleaner of claim 6, wherein the water cleaning device further includes:

an elastic member that is configured to maintain the movable member decoupled from the stationary member using an elastic force.

8. The cleaner of claim 6, wherein the tank body includes:

an accommodating part that is configured to accommodate the movable member, wherein the accommodating part is coupled to the base.

9. The cleaner of claim 8, wherein the movable member includes a hook, and wherein the accommodating part includes a projection part that is configured to couple to the hook to hold the movable member.

10. The cleaner of claim 1, wherein the movable member is configured to contact the cloth at the first position, the cloth being held by the water tank.

11. The cleaner of claim 10, wherein the water tank includes:

a tank body that includes the air hole, and a base that is coupled to a first side of the tank body, wherein each of the tank body and the base includes a respective opening through which the movable member is configured to pass, and wherein the movable member includes a shielding part that is configured to block the air hole.

12. The cleaner of claim 11, wherein the water cleaning device further includes:

an elastic member (i) that is respectively coupled to the cap and the movable member and (ii) that is configured to maintain the movable member in a position that closes the air hole using an elastic force, and wherein the cap is coupled to the water tank and configured to cover the movable member.

13. The cleaner of claim 12, wherein the water tank includes:

a projection that is configured to block the movable member from rotating, and wherein the shielding part includes:

a projection groove that is configured to couple to the projection.

14. The cleaner of claim 10, wherein the water tank includes:

a tank body, and a base that is coupled to a first side of the tank body, wherein the base includes:

an air introduction guide that extends from the base and that includes the air hole, and wherein the movable member is configured to be accommodated in the air introduction guide.

15. The cleaner of claim 14, wherein the water cleaning device further includes:

an elastic member (i) that is respectively coupled to the air introduction guide and the movable member and (ii) that is configured to provide an elastic force to the movable member, and wherein the cap is coupled to the base and configured to support the movable member, and includes an opening through which the movable member passes.

16. The cleaner of claim 15, wherein the movable member is configured to:

move between the first position and the second position by an external force, and based on a position of the movable member, open the air hole to introduce air into the water tank through the air hole.

17. The cleaner of claim 15, wherein the movable member is configured to:

move between the first position and the second position by an external force, and based on a position of the movable member, open the air hole to draw air through an airflow path that is formed between the cap and the movable member.

18. A water cleaning device comprising:

a water tank that is configured to (i) hold a cloth and (ii) provide water to the cloth, the water tank including:

an air hole through which air enters the water tank from outside of the water tank, and a water storage area that is configured to store water;

a control device (i) that is movable in the water tank, (ii) that is configured to control a flow of the air that enters through the air hole, and (iii) that is configured to move outside of the water storage area to open or close the air hole; and a cap configured to insert into the water tank and to cover the control device.

19. The water cleaning device of claim 18, wherein the control device is configured to move between a first position and a second position in the water tank.

20. The water cleaning device of claim 18, wherein the control device protrudes to a first side of the water tank and is configured to couple to the cloth that is held by the water tank.

* * * * *